United States Patent [19]

Barmore

[11] 4,248,435

[45] Feb. 3, 1981

[54] GAME TARGET WITH TETHERED PROJECTILE

[76] Inventor: Thomas C. Barmore, 4N 127 Verrill, Adison, Ill. 60101

[21] Appl. No.: 71,376

[22] Filed: Aug. 30, 1979

[51] Int. Cl.[3] ..... A63B 67/10

[52] U.S. Cl. ..... 273/331; 273/414; 273/DIG. 19

[58] Field of Search ..... 273/331, 414, 1.5 A, 273/329, 330, DIG. 19

[56] References Cited

U.S. PATENT DOCUMENTS 3,610,622 10/1971 Haroski ..... 273/331

3,814,359 6/1974 Powell ..... 273/1.5 A X 4,059,271 11/1977 Dupre ..... 273/414

*Primary Examiner*—George J. Marlo

*Attorney, Agent, or Firm*—Richard C. Lindberg

[57] ABSTRACT

A ball and cup game or exercise device arranged to be supported on the waist belt of a human, wherein by proper movement of the human body the ball is caused to be moved into the cup. The device comprehends a unitary structure having limbs engaging the waist belt, the front limb supporting a cup retaining the ball, which is held by a strand to the cup, upon proper movement of the body the ball moving into the cup either directly or by rebounding from the front limb.

1 Claim, 6 Drawing Figures

GAME TARGET WITH TETHERED PROJECTILE

SUMMARY OF THE INVENTION

The device disclosed in this application is for the purpose of simulating ball and basket types of games, such as basketball, and consists of a cup for receiving a pendently supported ball, the ball being received in the cup by suitable movement of a human body supporting the device.

THE DRAWING

Figure 3:
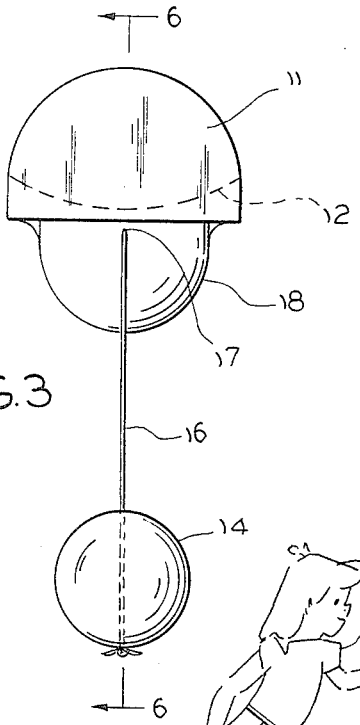
FIG. 3 is a front view thereof.
Figure 4:
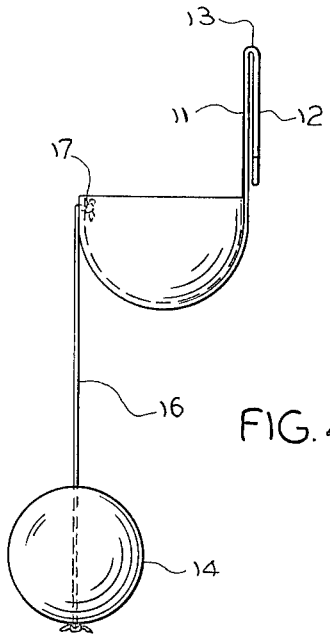
FIG. 4 is a side view thereof.
Figure 1:
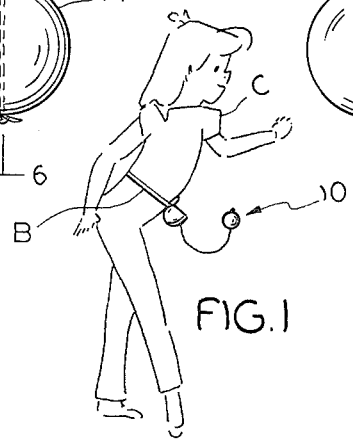
FIG. 1 is a showing of the invention structure in situ supported on the body of a user thereof.
Figure 5:
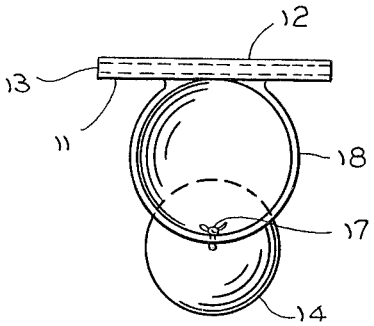
FIG. 5 is a top view thereof.

The invention structure is denoted generally by the reference numeral 10 and is shown as attached to a child C having a belt or waistband B to which the invention structure 10 is attached.

Structure 10 is a unitary kind which may be made in an injection molding operation, for example, and includes a front limb 11 and a back limb 12 joined along a connecting bight 13, the two limbs 11 and 12 embracing therebetween the belt C for support by the same and the child C.

The frontal area of front limb 11 is of such area as to act much in the nature of a rebound surface for a ball 14 connected by a flexible strand 16 to a ball receiving cup 18 supported at the lower extremities of front limb 11.

Figure 6:
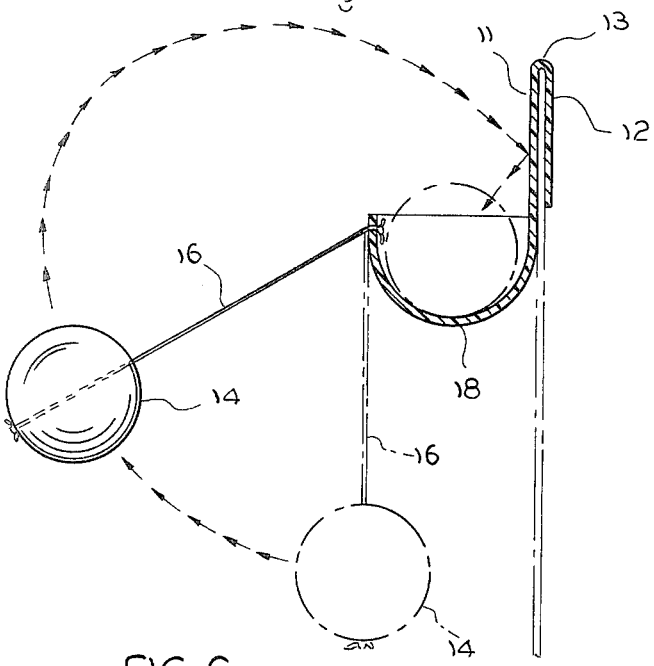
FIG. 6 is a sectional view taken along the line 6—6 of FIG. 3 looking in the direction of the arrows.
Figure 2:
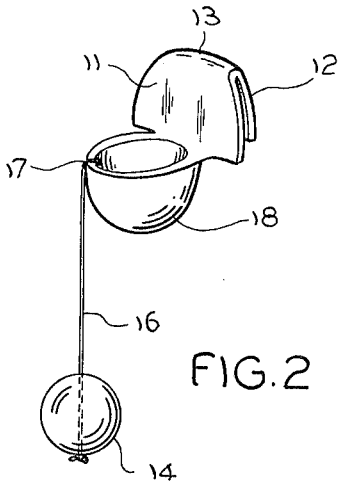
FIG. 2 is a perspective view of the invention device.

Upon proper movement of the child C, the ball 14 is caused to swing properly in a direction as to fall directly into cup 18 or to rebound from front limb 11 into cup 18, as seen in FIG. 6. The user of the device 10, such user being the child C or an older person, by sufficient practice can obtain skill that the device may be used in competition.

I claim:

1. A ball and cup exercise or game device arranged to be attached to a waist belt on the human body wherein the proper movement of the body causes the ball to move into the cup, said device comprising:

(a) a unitary structure having front and rear closely spaced limbs connected along upper portions thereof;

(b) said limbs being arranged to embrace said belt when wrapped about a human body and to be supported on said belt;

(c) a ball receiving and retaining cup secured to the lower extremity of said front limb, said front limb being tangent to the rear of said receiving cup;

(d) a ball connected to a flexible strand having a connection to said ball receiving cup;

(e) the frontal area of said front limb providing with said ball upon proper movement of the body for rebounding of said ball at times into the cup secured to said front limb.

* * * * *